United States Patent [19]

Henry

[11] Patent Number: 4,867,078

[45] Date of Patent: Sep. 19, 1989

[54] BURNER

[75] Inventor: Donald D. Henry, 290 Wainoni Rd., Christchurch, New Zealand

[73] Assignees: Donald David Henry; Adrienne Leigh Henry, both of Christchurch, New Zealand

[21] Appl. No.: 38,346

[22] Filed: Apr. 14, 1987

[30] Foreign Application Priority Data

Apr. 16, 1986 [NZ] New Zealand ..... 215844

[51] Int. Cl.[4] ..... F23D 1/02

[52] U.S. Cl. ..... 110/264; 110/105

[58] Field of Search ..... 110/264, 347, 105, 104 R; 431/173

[56] References Cited

U.S. PATENT DOCUMENTS 4,052,266 10/1977 Griffith ..... 110/264 X
4,311,102 1/1982 Kolze et al. ..... 110/105 X
4,574,711 3/1986 Christian ..... 110/264

*Primary Examiner*—Edward G. Favors

*Attorney, Agent, or Firm*—Christensen, O'Connor Johnson & Kindness

[57] ABSTRACT

A burner including a cyclone shaped housing divided by a baffle plate into an upper cyclone chamber and lower chamber, the walls of the chambers are formed to resist heat and corrosion, the baffle plate extends across a major portion of the width of the chamber and is positioned above an inlet to the lower chamber, the upper cyclone chamber having a tangential air inlet near to a cover plate which extends across the upper chamber and which has an outlet from the chamber centrally situated therein, the arrangement being such that in operation a particulate fuel is blown into the upper chamber via the tangential inlet to then fall and burn around the outer edge of the baffle plate in the chamber into which additional air is blown from below to assist burning in the chambers, the heat produced and exhaust gases exiting from the outlet, for use, as required. The walls of the chambers can be manufactured from a stainless steel alloy which is heat resistant and surrounded by an air jacket through which air is drawn or blown to cool the outer wall, base and cover plate of the chambers.

15 Claims, 11 Drawing Sheets

BURNER

FIELD OF THE INVENTION

The invention relates to a burner and more particularly to a burner designed to incinerate and burn particulate materials.

BACKGROUND OF THE INVENTION

An object of the invention is therefore to provide a burner for particulate materials which burner can be used in a variety of situations to burn, for example, wood waste, bark, wood chips, sawdust and other similar combustible particulate materials.

A number of constructions of burner for particulate fuels have been proposed in the past and these include fluidised bed burners and cyclone burners.

Fluidised bed burners are constructed with an active bed of material into which fuel is fed to incinerate the material. The problem with such burners is that if complete combustion does not occur the unburnt or partly burnt combustion products tend to clog up the fluidised bed. The bed itself must be of special materials and this results in added costs. Fluidised bed burners often require additional fuel to be added to sustain combustion and this again adds to running costs. The size of existing fluidised bed burners is such that they do not lend themselves to installation in some situations and they are normally better suited for the destruction of waste or to supply additional heat from waste products at large scale industrial sites.

A number of constructions of cyclone burner for a range of particulate fuels have been proposed. Examples include the burners described in U.S. Pat. Nos. 4,597,342, 4,574,711, 4,561,364, 4,572,084 and 2,707,444 and European Pat. Specification No. 0 006 974.

In the said European Specification No. 0 006 974 is described the cooling of a complex burner by providing a spirally wound space around the burner shell. The burner being of the type constructed with a ceramic cladding. Although such a burner may be able to withstand the temperatures produced by normally combusting fuel in the chamber such a burner cannot withstand the temperatures produced during combustion with the present invention. The applicants experiments with refractory linings and ordinary steel as a firebox have shown that the linings deteriorate rapidly under the heat produced and that an ordinary steel firebox distorts in shape if high temperatures are produced in the burner.

Similar problems exist with the burners described in U.S. Pat. Nos. 2,707,444 and 4,574,711.

The constructions of burner described in Green et al's U.S. Pat. Nos. 4,597,342, 4,572,084 and 4,561,364 are cooled by the inclusion of a heat exchanger for water on the outside of what is a pre-entry chamber. It is the applicant's experience that such cooling is only effective to a limited degree and in any event is directed to adapting an oil burner to operate with a mixture of coal dust and gas. Such a construction is in the applicants opinion very distinct from the present invention which is designed to operate with particulate wood, sawdust and the like. The problems inherent in burning of this material are very different from the problems of combusting coal dust and gas.

SUMMARY OF THE INVENTION

According to a broadest aspect of the invention there is provided a burner including a cyclone shaped housing divided by a baffle plate into an upper cyclone chamber and lower chamber, the walls of the chambers are formed to resist heat and corrosion, the baffle plate extends across a major portion of the width of the chamber and is positioned above an inlet to the lower chamber, the upper cyclone chamber having a tangential air inlet near to a cover plate which extends across the upper chamber and which has an outlet from the chamber centrally situated therein, the arrangement being such that in operation a particulate fuel is blown into the upper chamber via the tangential inlet to then fall and burn around the outer edge of the baffle plate in the chambers into which additional air is blown from below to assist burning in the chambers, the heat produced and exhaust gases exiting from the outlet, for use, as required.

The walls of the chambers are adapted to resist heat and corrosion by lining the chamber with a refractory lining. Alternatively the walls of the chambers can be manufactured from a stainless steel alloy which has a high nickel content and surrounding the walls with an air jacket through which air is drawn or blown to cool the outer wall, base and cover plate of the chambers.

The baffle plate can be supported on support means relative to a centrally positioned inlet of the lower chamber. The baffle plate can support a downwardly depending member which acts as an air supply/flame duct up which air/flame is blown to be dispersed across the full width of the plate and from which air can be dispersed along the length of the member.

The lower air inlet can have associated therewith an ignition means operable while starting the burner.

The burner according to the present invention can be connected to a heat exchanger of the type described and claimed in New Zealand Pat. Specification No. 202042 or to a boiler, crucible or other heat requiring means for industrial, horticultural or domestic use including a flash dryer of the type designed to dry particulate wood waste.

The particulate fuel supplied to the burner can be fed directly thereto or from a remote storage unit. For example, the fuel can be dry or partially dry sawdust or the like blown from a hopper in a controllable manner direct to the tangential air inlet.

The rate of burning and heat output from the burner can be controlled by stop/starting the supply of fuel and/or controlling the rate of air supplied to the tangential and lower air inlets.

DESCRIPTION OF THE PREFERRED EXAMPLE

Figure 1:
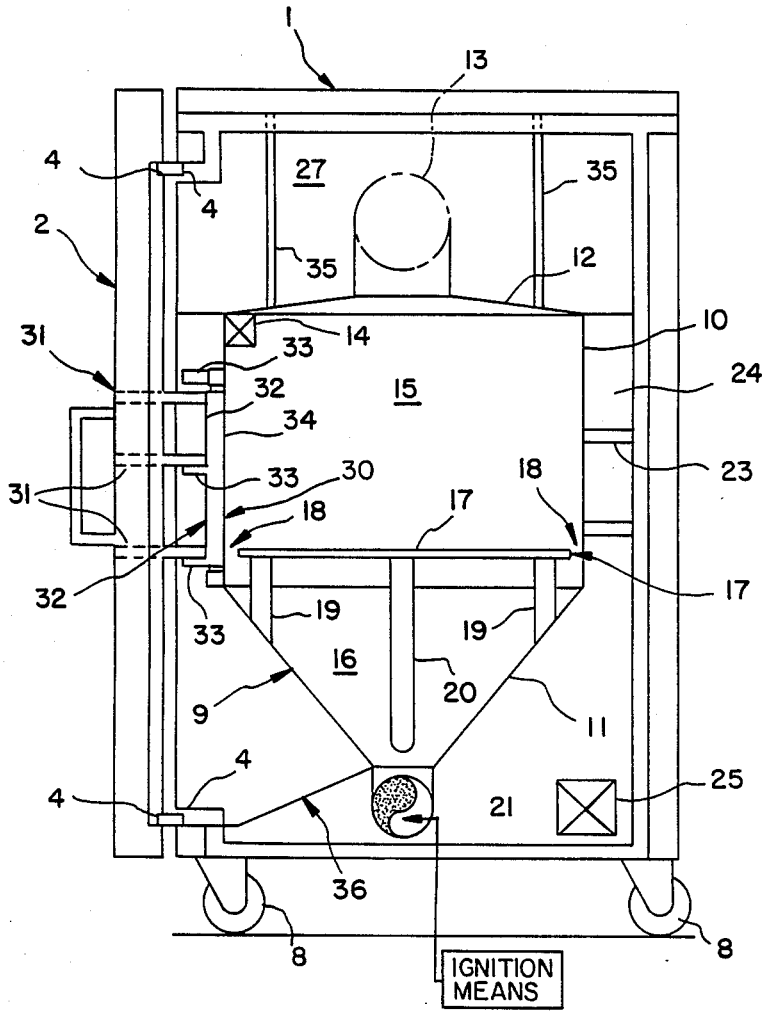
FIG. 1 is a plan view of a burner according to the invention.
Figure 3:
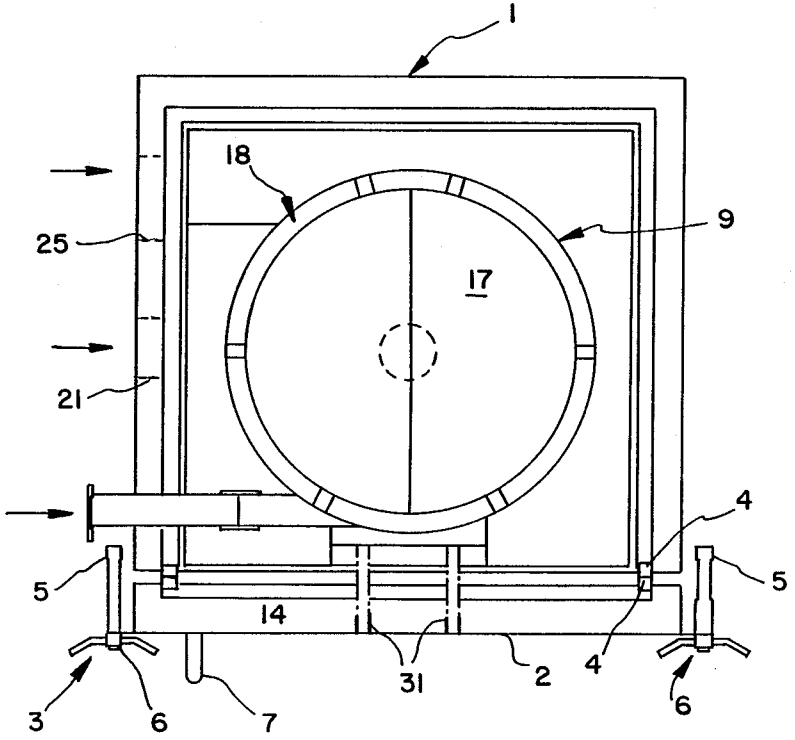
FIG. 3 is a front elevational view of the burner shown in FIGS. 1 and 2 in which the cabinet and burner door are omitted for clarity.
Figure 2:
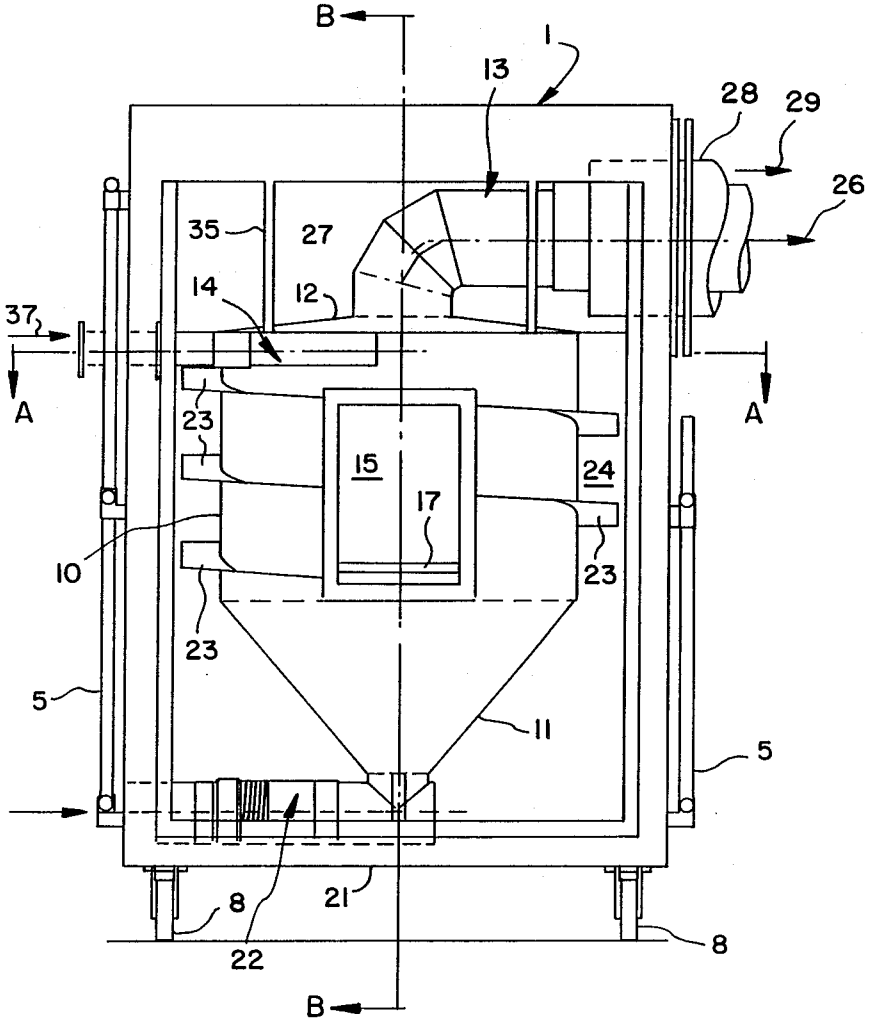
FIG. 2 is a vertical section through the burner shown in FIG. 1.

The preferred example of burner according to the invention is shown in FIGS. 1 to 3 and is constructed from suitable fire and heat resistant materials as described.

The outer cabinet housing 1 is fabricated or cast from a metal material within which is a refractory material like Insulrock as a lining or insulation. The cabinet 1 has a door 2 (FIGS. 1 and 2) which is locked shut when the burner is operating. The door 2 has the locking means 3 for clamping same shut to compress the heat resistant seals 4. The door 2 is mounted on rods 5 and the distance between adjustment means 6 and the rods on both sides of the door 2 allow the seals 4 to be compressed. The door 2 has handle 7 for opening the cabinet 1 for maintenance. The example of cabinet shown is mounted on wheels 8. It is envisaged that alternatively the wheels 8 can be omitted and the cabinet mounted on a suitable mounting base.

The cabinet 1 has mounted therein the burner 9 which is cyclone shaped and is circular in plan. The burner is preferably constructed from 253MA grade stainless steel or the like which is a stainless steel alloy with a high nickel content. The burner 9 has a cylindrical region 10 and conical base 11. The top of the burner 9 has a cover plate 12 with an outlet 13.

The upper part of the region 10 has a tangential inlet 14 through which particulate fuel is blown as described hereinafter.

The burner 9 is divided into an upper cyclone chamber 15 and lower chamber 16 by a baffle/burner plate 17. The plate 17 extends across a major portion of the width of the burner 9 and forms an annular gap 18. The gap 18 allows fuel to drop into the bottom of the conical base 11 and allows flames and air to rise upwardly around the edge of the plate 17 as described hereinafter.

The plate 17 is supported above the conical base 11 on legs 19. The plate 17 is preferably formed as two hemispherical plates supported at the centre by a member 20.

The bottom of the conical base 11 has an air inlet tube 21 which can have a flexible region 22 before it passes through the housing 1. The ignition means can be an electric element or the like which is operated during the starting cycle of the burner 9.

The outer periphery of the burner 9 has a spiral shaped plate 23 fixed thereto thus forming a spiral shaped cooling path 24 around the outside of the burner 9. The burner 9 is manufactured from a metal alloy having a high nickel content to thereby be resistant to the high temperatures produced by combustion therein. The cabinet 1 has another air inlet 25 through which body cooling air passes in the direction of arrow 26. The air through inlet 25 passes around the burner 9 up the spiral shaped cooling path 24 into the space 27 surrounding the outlet 13 before passing through the annular gap 28 surrounding the outlet 13. This flow of air in the direction of arrow 29 produces a cooling effect on the burner casing 9 so that it can withstand higher temperatures without breaking down.

The burner 9 has a door 30 which is maintained closed by springs 31 when the door 2 is closed. The door 30 has an outer plate 32 with handle means 33 and an arc shaped, in plan, inner plate 34 which maintains the cylindrical contours of the interior of the burner 9. The burner 9 is supported within the cabinet 1 by braces 35 and retaining straps 36.

The fuel is supplied to the burner 9 via the tangential air fuel inlet 14. The air flow in the direction of arrow 37 to the upper region of the chamber 15 has entrained therewith the particulate fuel.

Figure 4:
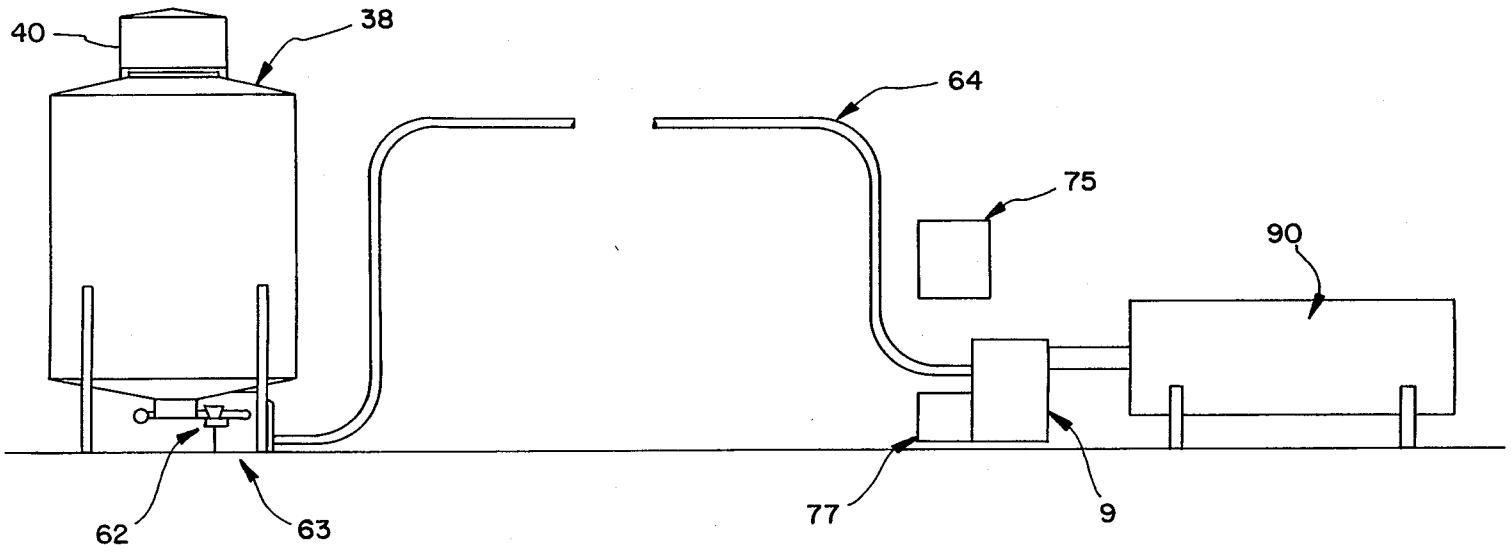
FIG. 4 is a schematic drawing of the burner shown in FIGS. 1 to 3 situated with a fuel storage, fuel feed and boiler operated by the burner.

A variety of fuel supply systems are envisaged and an example is shown in FIGS. 5 to 12 and its overall layout is shown in FIG. 4. In this example the fuel is stored in a silo unit 38 (FIGS. 4 to 6) which is in a position adjacent or remote from the burner 9. The silo unit 38 is a generally cylindrical unit with a manhole 39 in its top surface at the centre of which is a dust collector 40. The side walls of the unit 38 can have sight glasses 41 for ascertaining the fuel level therewithin. The unit 38 is supported by legs 42 and the base thereof is surrounded by a removable skirt 43. The skirt 43 allows access to a fuel feed auger 44 shown in detail in FIG. 7.

The sloping base 45 of the silo unit 38 has an inflater bag 46 (FIG. 6 which is annular in shape) fixed thereto. The inflater bag 46 which is constructed from a rubberized material or the like may be reinforced and surrounds the central control recess 47 at the base of the unit 38. The inflater bag 46 is expanded by the means 48 (FIG. 8) suspended from the base wall 49 of the unit 38. The means 48 includes an electric motor 50 for blowing up the inflater bag 46 to loosen the fuel in the base of the unit 38. The motor 50 is surrounded by a cover 51 to protect it against dust and other matter.

Figure 5:
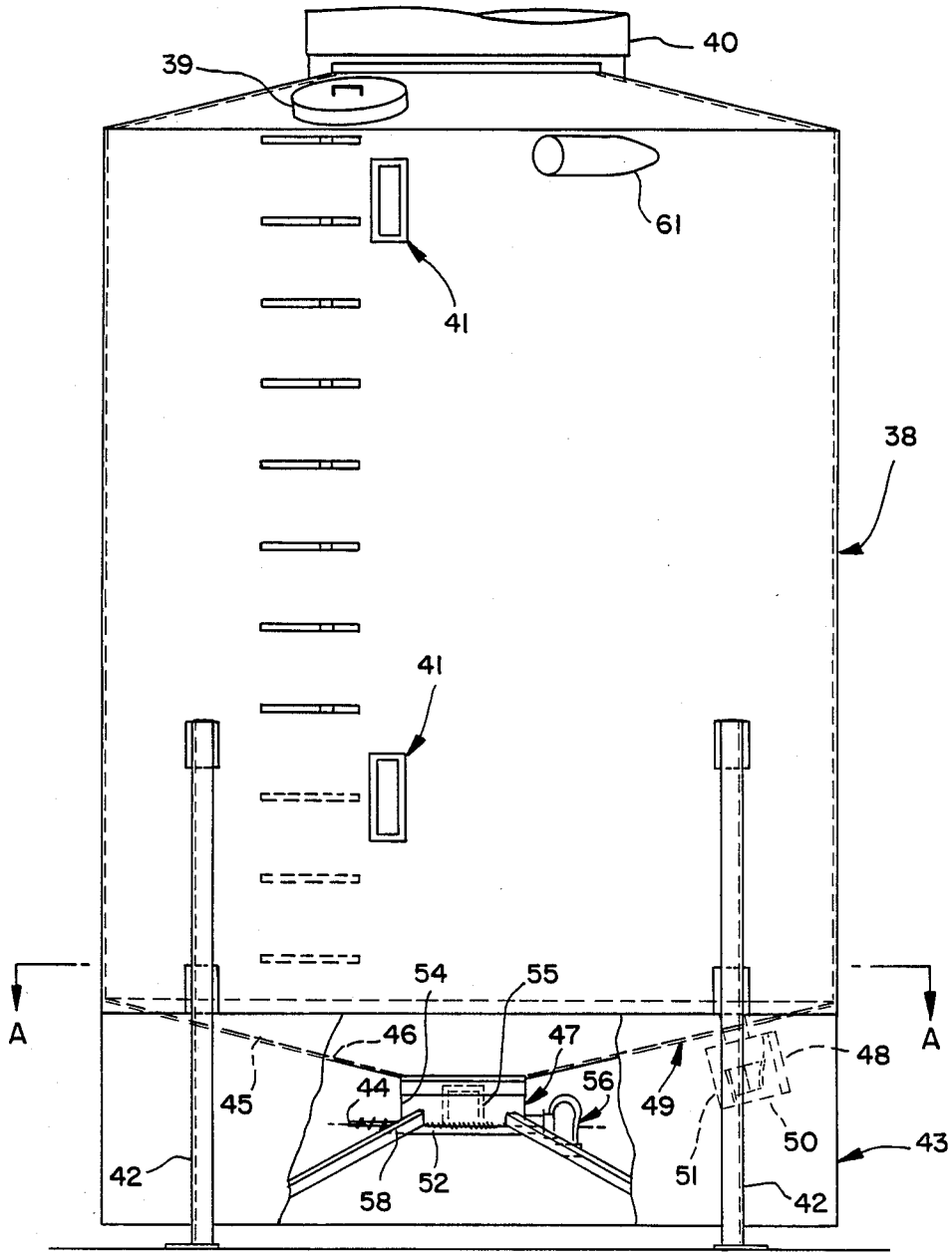
FIG. 5 is an elevational view partly sectioned of the fuel storage unit shown in FIG. 4.
Figure 6:
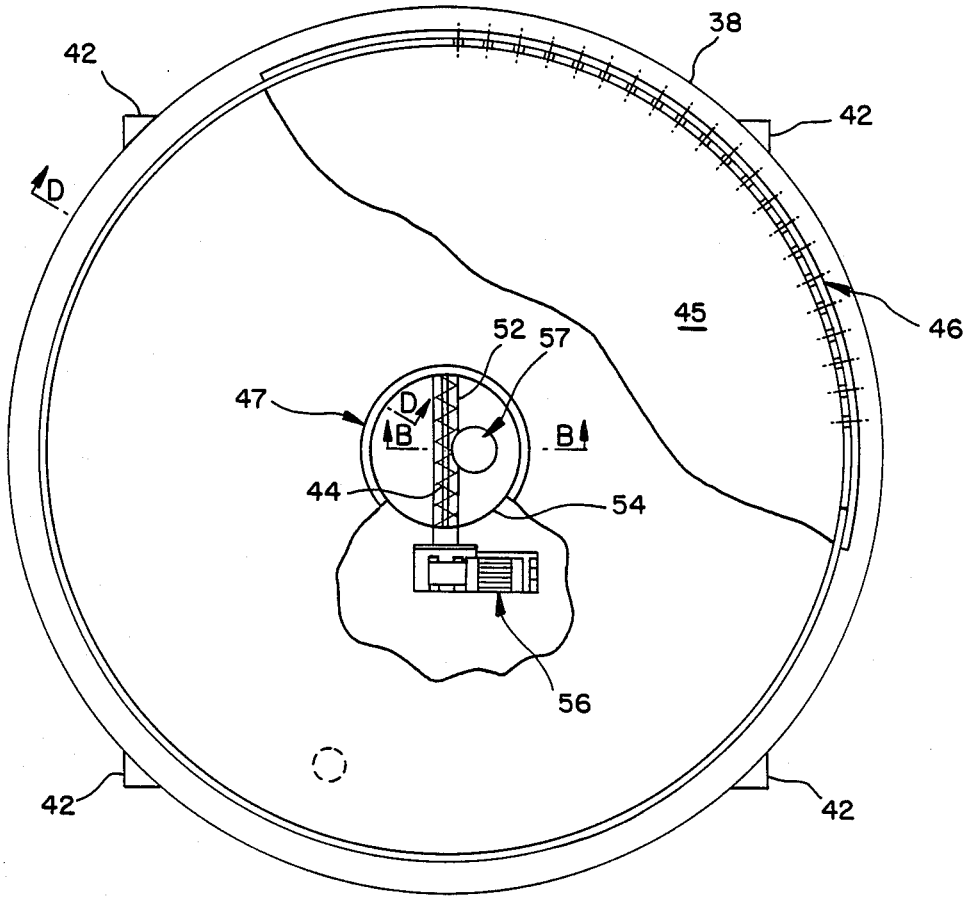
FIG. 6 is a section on the lines A—A through the fuel storage unit shown in FIG. 5.
Figure 7:
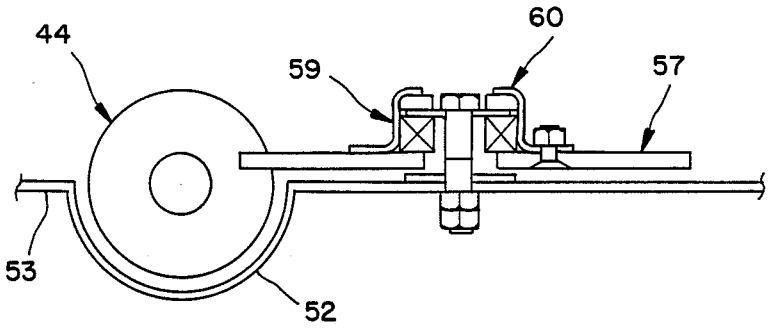
FIG. 7 is a section on the lines B—B through the fuel feed auger shown in FIG. 6.
Figure 8:
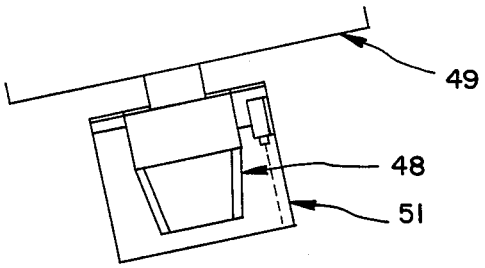
FIG. 8 is a section of the lines C—C through the means for inflating an inflater bag in the base of the fuel storage unit as shown in FIG. 6.
Figure 9:
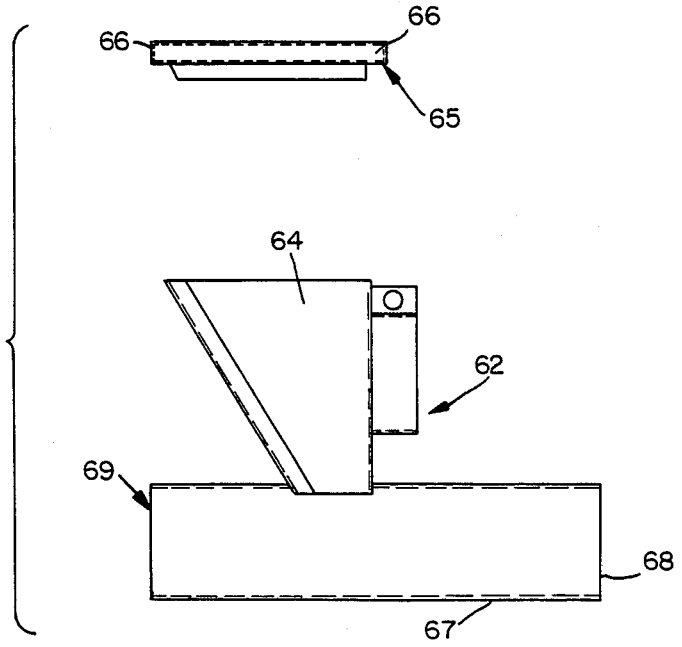
FIG. 9 is a side view of a connector for joining the fuel feed auger to a fuel feed fan.
Figure 10:
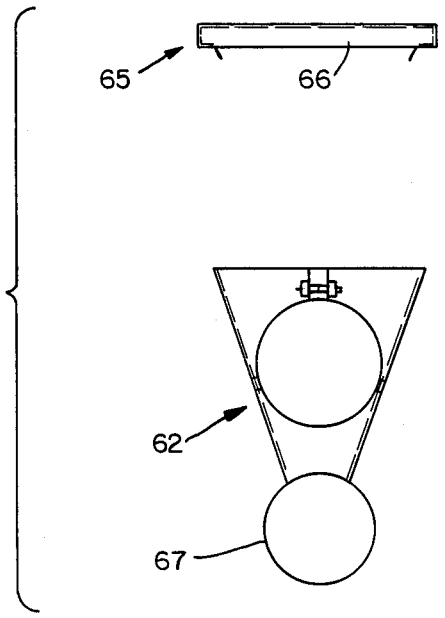
FIG. 10 is a front view of the connector shown in FIG. 9.

The fuel feed auger 44 (FIGS. 5, 6 and 7) is situated in the recess 47 and is mounted in channel 52 across the bottom 53 of the recess 47. The recess 47 has in its side wall 54 a cover plate 55 for maintenance purposes. The auger 44 is rotated by an electric motor 56 and rotation thereof turns a daisy wheel 57 (FIGS. 6 and 7). The upper surface of the daisy wheel 57 may have thereon a textured surface or a series of lugs (not shown) so that rotation thereof tends to free the mass of fuel in the recess 47 and feed it toward the auger 44 and the end of outlet tube 58. The daisy wheel 57 has on its periphery cut outs (not shown) which interact with the auger 44 to cause rotation thereof. The mounting for the daisy wheel 57 is shown in FIG. 7 and is via a bearing 59 covered and protected by cover member 60.

The fuel is supplied to the unit 38 by a number of means for example through a tangential inlet 61 in the upper part of the wall of the unit 38.

The fuel feeds from the auger 44 via feed fan connector 62 to feed fan 63 which blows the fuel via a feed line 64 (FIG. 4) to the burner 9.

Figure 11:
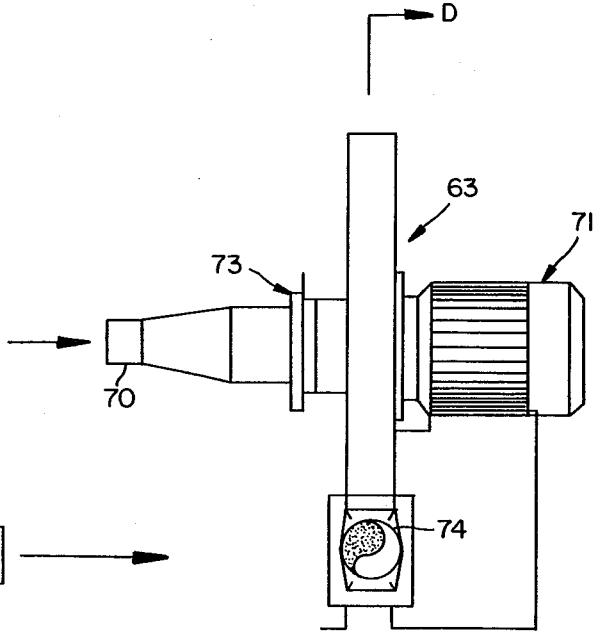
FIG. 11 is an end view of a fuel feed fan for attachment to the connector shown in FIGS. 9 and 10.
Figure 12:
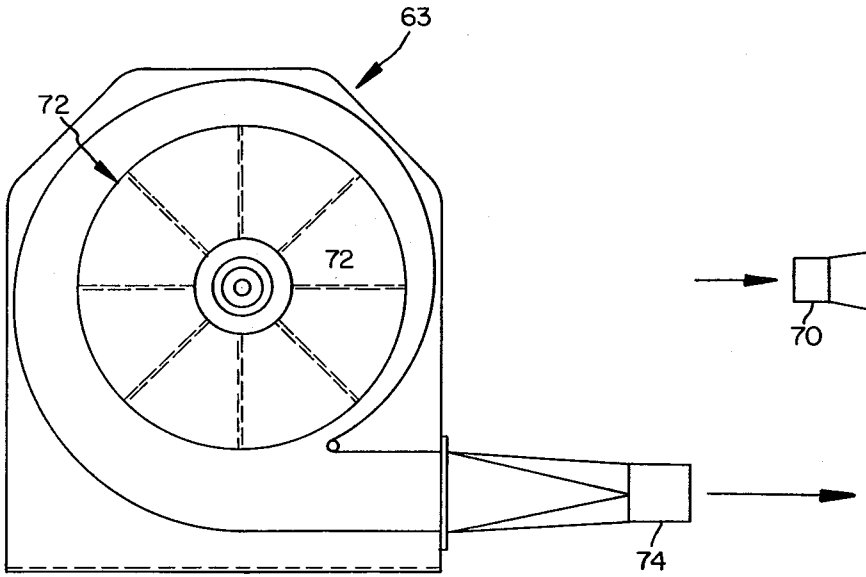
FIG. 12 is a section on the lines D—D through the fuel feed fan shown in FIG. 11.

The feed fan connector 62 is clamped by sleeve 63 to the end of the outlet tube 58. The auger 44 in FIG. 5 is shown longer than it is actually needed and it is cut off on site when it is being installed. The connector 62 includes a hopper region 64 with a cover member 65 shown in FIGS. 9 and 10 spaced above the position it adopts in use. The cover member 65 does not seal the top of the hopper region 64 as either end 66 of the cover member 65 is open to allow air to flow down into the hopper region 64. The bottom of the region 64 is connected to a pipe 67 which in use is open at end 68. The other end 69 is connected either directly or via a flexible hose to an inlet 70 to the fuel feed fan 63 (FIGS. 11 and 12).

The fan 63 is operated by an electric motor 71 which drives impeller 72. The inlet 70 is connected via a gate valve 73 to the centre of the impeller 72. The casing for the impeller 72 is scroll shaped and ends in an outlet 74 which is connected to the feed line 64. The feed line 64 terminates at the tangential inlet 14 of the burner 9.

In use the auger 44 and fan 63 when operating feed fuel in a controllable manner to the air stream produced by fan 63 (through the open end 68) to be blown along feed line 64 to the burner 9.

Figure 13:
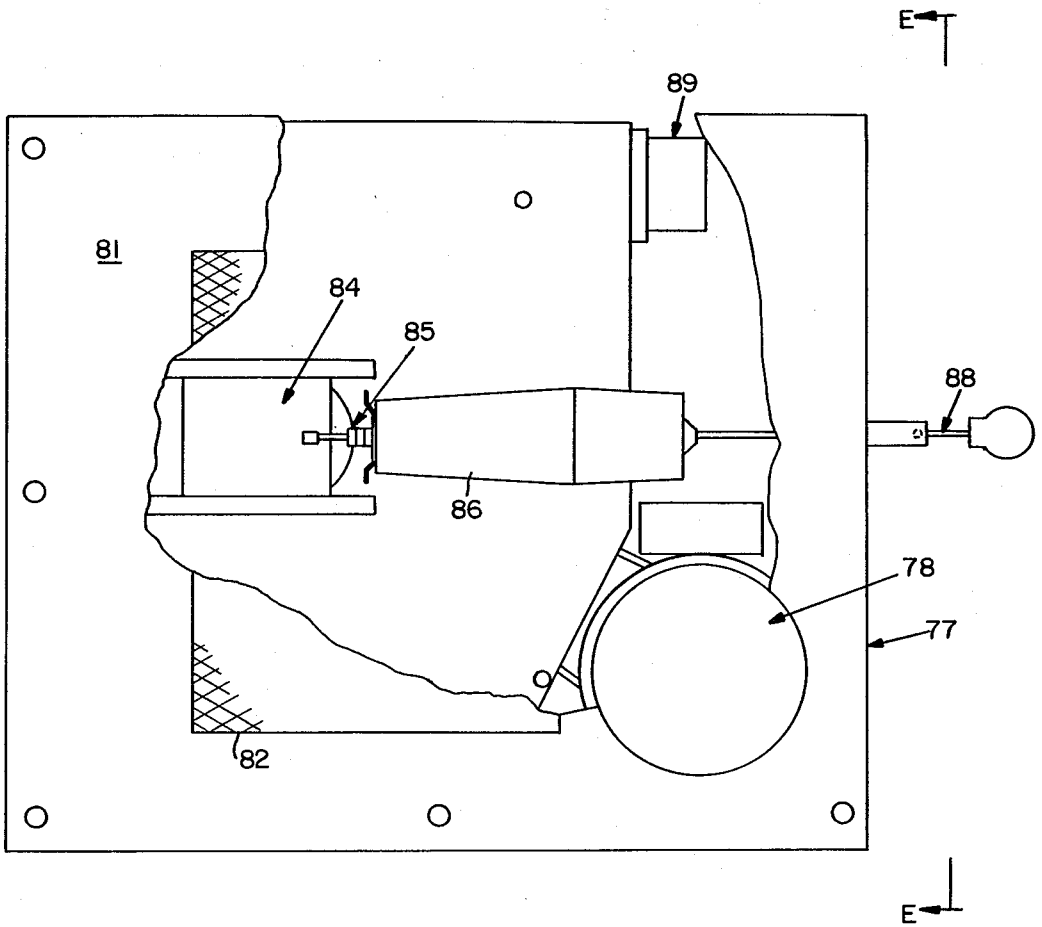
FIG. 13 is an elevation partly sectioned of a housing for grate air and cooling air fans.
Figure 14:
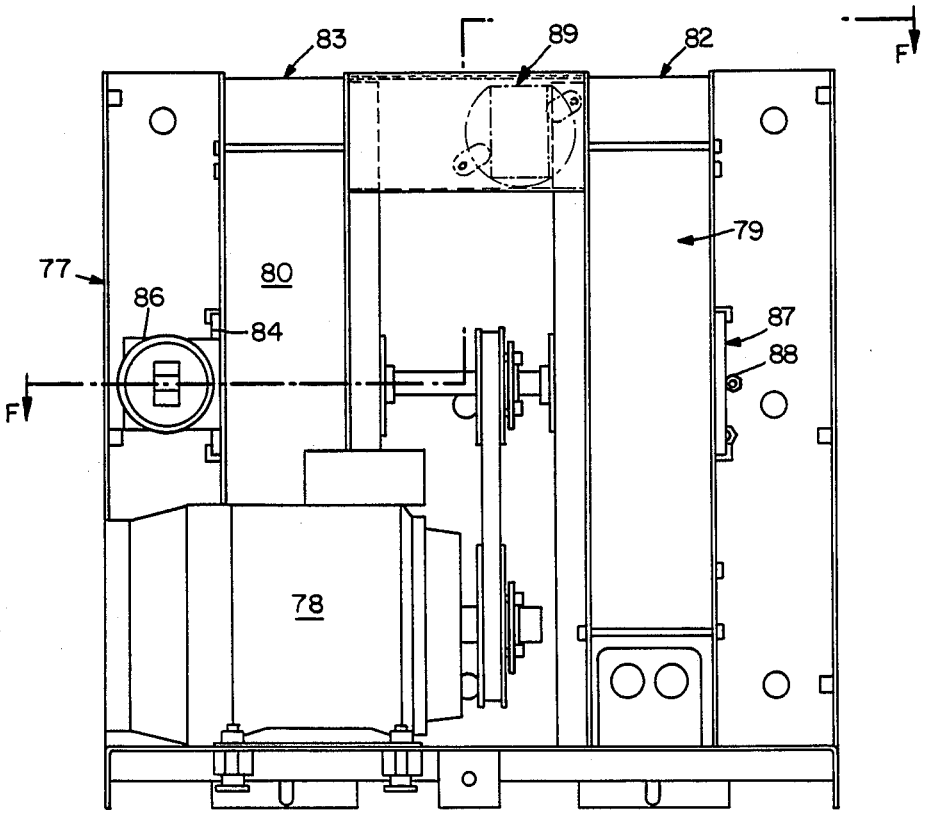
FIG. 14 is a sectional view in the direction of arrows E—E of FIG. 13.
Figure 15:
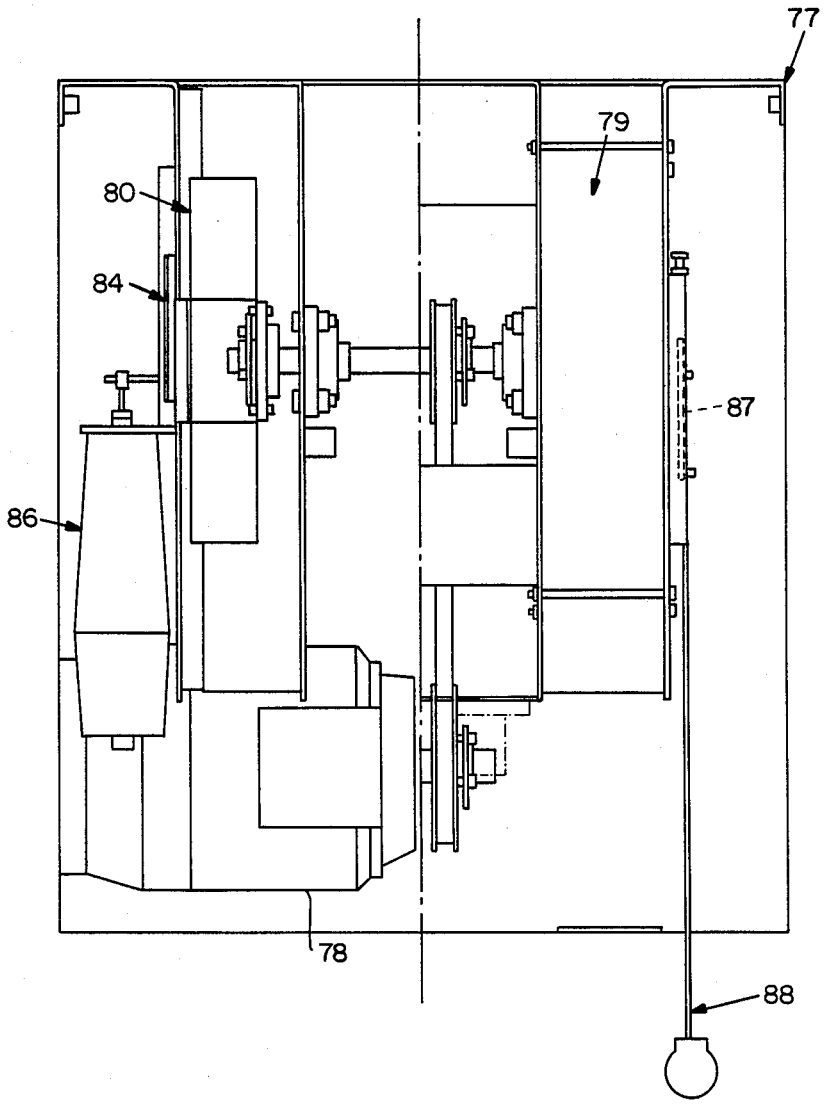
FIG. 15 is a plan view of the fans shown in FIG. 13 on the lines F—F.

The operation and heat output of the burner 9 is controlled by a controller in cabinet 75 (FIG. 4) by adjusting fuel flow via feed line 64, and the volume of grate air from the grate air and cooling fan (FIGS. 13 to 15). The grate air and cooling fan is situated alongside cabinet 1 (FIG. 4) in housing 77. The housing 77 has a fan motor 78 connected to drive simultaneously two impellers 79 and 80. The impeller 79 supplies air to the lower grate chamber 16 of the burner 9. The other impeller 80 supplies cooling air to the interior of the cabinet 1 via inlet 25. The sides 81 of the housing 77 have a grill 82 (only one of which is shown FIG. 13) through which air is drawn by the impellers 79,80 before being blown from the outlets 82,83 respectively to the inlets 21,25 for the grate air and cooling air to the burner 9.

The supply of air to impeller 80 is controlled by providing a sliding gate valve 84 or the like over the inlet 85 which is alongside the impeller. The grate valve 84 can be controlled by actuator 86 the operation of which is preferably controlled by a thermo couple or the like on the burner casing. This ensures that cooling air is always maintained and the gate valve 84 is connected so that it never fully closes.

The supply of air to the other impeller 79 is controlled by a gate valve 87 moved manually by actuator rod or choke 88. The movement of the choke 88 may alternatively be automaticallay controlled if necessary. The choke 88 controls the grate air flow and therefore heat output of the burner.

The housing 77 may include a pressure switch 89 positioned to sense increases in pressure with the housing 77 created by greater air pressure from the fuel feed fan 63 than produced by the grate air fans impeller 79. If this occurs the burner 9 is automatically shut down. The feed line 64 may include a pressure sensor designed to ensure that the air pressure in the burner from the fuel supply system is always greater than the pressure from the grate air so that burning cannot occur back down the fuel line 64.

In use at start up an initial supply of fuel is fed to the burner by operation of the fan 63 which in association with the auger 44 allows a selected volume to be blown to the grate. The fuel when entering the cyclone chamber 15 falls under gravity around the outside wall of the chamber onto the conical base 11 and down into the inlet tube 21 until the fuel builds up around the tube 20 and under the plate 17. The fan 63 is then switched off and the ignition means activated or a suitable ignition means if turned on while air is blown by grate fan propeller 79. The ignition means is operated for a preset period until a fire is burning in the lower burning chamber 16. The fire is promoted by air flowing up the tube and from the outlets therein. The fire burns radially outward around the edges of the plate 17. The fan 63 can be operated in association with fan impeller 79 but at a lower speed without fuel supply during this start up sequence. When a fire is burning adequately in the chambers the ignition means is automatically cut off and complete combustion continues.

The rate of combustion is controlled by the rate at which fuel is supplied by fan 63 and grate air is supplied by fan 79. Control equipment ensures that the rate of output from fan 79 is such that fire is not blown into the fan 79 by the fan 63.

The air supplied by the fans controls combustion which occurs around and under the burning plate 17. The partly burnt fuel dropping under gravity in the upper chamber 15 fall to be reburnt around the periphery of the plate 17 before burnt gases exit from the outlet 13.

The outlet 13 can be connected to any heat exchanger, boiler or the like 90 (FIG. 4) through which the hot exhaust gases pass before passing to a flue (not shown) to atmosphere.

The applicants' trials have shown that heat/flame produced from the outlet 13 when using dry wood or sawdust like particulate materials is substantial and a high and efficient heat output is produced. This makes the operational running costs of such a unit very cost competitive and efficient when compared to other fossil fuel burners.

Thus by this invention there is provided a burner for particulate materials which burner can be used in a wide variety of situations to burn, for example, sawdust, wood waste, bark, wood chips and other combustible particulate materials.

A particular example of the invention has been described by way of example and it is envisaged that modifications can take place without departing from the scope of the appended claims.

What I do claim and desire to obtain by Letters Patent of the United States is:

1. A burner including a cyclone shaped housing divided by a baffle plate into an upper cyclone chamber and lower chamber, the walls of the chambers are formed from a stainless steel alloy which has a high heat resistance and wherein the walls are surrounded by a cabinet forming an air jacket, the jacket includes a spirally wound plate mounted on the outside walls of the cyclone shaped housing, the baffle plate extends across a major portion of the width of the chamber and is positioned above an inlet to the lower chamber, the upper cyclone chamber having a tangential air inlet near to a cover plate which extends across the upper chamber and which has an outlet from the chamber centrally situated therein, the inlet to the lower chamber has associated therewith an ignition means operable while starting combustion, the arrangement being such that after combustion has started and in operation a particulate fuel is blown into the upper chamber via the tangential inlet to then fall and burn around the outer edge of the baffle plate in the chambers into which additional air is blown from below to assist burning in the chambers, the heat produced and exhaust gases exiting from the outlet, for use, as required.

2. A burner as claimed in claim 1 wherein air is drawn or blown through the air jacket to cool the outer wall, base and cover plate of the chambers.

3. A burner as claimed in claim 2 of the preceding claims wherein the baffle plate is supported on support means above a centrally positioned inlet of the lower chamber.

4. A burner as claimed in claim 3 wherein the support means for the baffle plate are a plurality of upstands mounted on the base of the lower chamber including a generally central upstand(s) for supporting the central region of the baffle plate.

5. A burner as claimed in claim 4 wherein the baffle plate is formed in two halves.

6. A burner as claimed in claim 1 wherein the particulate fuel is supplied from a remote storage unit.

7. A burner as claimed in claim 6 wherein the remote storage unit is a silo shaped unit from which the fuel is removed by a fuel feed auger to a fuel feed fan which blows air and the entrained fuel through a duct to the tangential fuel inlet of the upper chamber.

8. A burner as claimed in claim 7 wherein the silo unit has in the center of its base a recess in which the fuel feed auger is mounted, the sloping base of the silo unit having an annular shaped, in plan, inflater bag fitted thereto.

9. A burner as claimed in claim 8 wherein the fuel feed auger is mounted in a transverse tube in the base of the recess, the auger being adapted to rotate a daisy wheel which frees the fuel and directs same into the recess.

10. A burner as claimed in claim 6 wherein the fuel feed fan is mounted alongside the fuel feed auger and is connected thereto by a connector having a hopper region into which the fuel is dropped by the auger to fall into an open ended fuel feed pipe connected to an inlet of the fan which entrains the fuel and/or forces same to the chamber via the tangential inlet.

11. A burner as claimed in claim 10 wherein the rate of burning and heat output from the burner is controlled by stop/starting the supply of fuel and/or controlling the ratio of air supplied to the tangential air inlet and additional air inlet.

12. A burner as claimed in claim 1 wherein the additional air and cooling air are supplied by a combined fan unit in which a single motor drives two impellers the outputs of which are directed to the inlet of the lower chamber and to an inlet in the base of the cabinet respectively.

13. A burner as claimed in claim 12 wherein the fan unit has a gate valve on the inlets for each impeller casing, the gate valves being operable to modify the throughput of air to each fan separately.

14. A burner as claimed in claim 13 wherein the cooling air from the jacket around the burner is ejected from the cabinet via an annular gap surrounding the outlet of the burner for use as additional heat output.

15. A burner as claimed in claim 14 wherein operation thereof is governed by an electronic control system adapted to maintain a desired temperature output while maintaining the pressure created in the burner by the grate air fan greater than that produced by the fuel feed fan or the burner automatically shuts down.

* * * * *